United States Patent [19]

Kallio

[11] Patent Number: 4,951,908

[45] Date of Patent: Aug. 28, 1990

[54] SHELF ASSEMBLY FOR A CLOSET

[75] Inventor: James H. Kallio, Chapman Rd., S. Barre, Mass. 01074

[73] Assignee: James H. Kallio, S. Barre, Mass.

[21] Appl. No.: 382,406

[22] Filed: Jul. 20, 1989

[51] Int. Cl.[5] ..... E04G 3/08

[52] U.S. Cl. ..... 248/248; 248/250; 108/108; 211/90

[58] Field of Search ..... 248/248, 247, 250, 251, 248/335; 108/108; 52/36, 238.1, 239; 211/90

[56] References Cited

U.S. PATENT DOCUMENTS

| | | | |
|---|---|---|---|
| 2,906,487 | 9/1959 | Simon | 248/248 |
| 2,960,761 | 11/1960 | Preader | 248/248 |
| 3,185,426 | 5/1965 | Bjerke | 248/250 |
| 3,325,130 | 6/1967 | Smith et al. | 248/250 X |
| 3,357,374 | 12/1967 | Smith et al. | 211/90 X |
| 3,511,193 | 5/1970 | Schild | 248/250 X |
| 3,862,784 | 1/1975 | Heinrich | 108/108 X |
| 4,018,019 | 4/1977 | Raith et al. | 52/36 X |

*Primary Examiner*—Alvin C. Chin-Shue

[57] ABSTRACT

A closet shelf bracket pair formed of sheet metal having a flat main body with channels and supports defined in the main body by tabs bent from the main body for the purpose of guiding and supporting a load bearing member and a shelf board. Also, the main body of the shelf bracket pair provides a means for attachment of the shelf bracket pair to the interior opposing side walls of a closet and aligning the mounting hardware used for attachment with an interior wall stud. Each bracket is identical in features except they are a mirror image to one another.

8 Claims, 5 Drawing Sheets

SHELF ASSEMBLY FOR A CLOSET

FIELD OF THE INVENTION

This invention is concerned with a stamped metal pair of brackets for the purpose of supporting a shelf board and a load bearing member.

A further aspect of this invention is the novelty of the design which provides for minimal assembly time and an assembly of great load carrying ability.

DESCRIPTION OF PRIOR ART

There is no standard or universal practice in use today for the installation of closet shelving but some of the more common methods are; One, the attachment of wood strips on the back and side walls of a closet with the shelf board set on top of these wood strips; Two, there are triangular shaped brackets which attach to the rear wall of a closet thus providing a support arm for the shelf board to rest on; Three, there are wire form shelfs which rest on hangers or hooks which have been attached in several locations along the back and side walls of a closet.

An objection to these previously stated methods of closet shelving installation is the attachment of support members to the rear wall in that finding the wall studs for securing these support members is difficult and time consuming as the finish wall obviously covers the wall studs. For types of fasteners which attach to the wall board or plaster only, there is a great reduction in the load carrying ability of the support member.

Another objection to the previously stated methods of closet shelving installation is the quantity of hardware used to secure the support members making all of these methods labor intensive.

SUMMARY OF THE INVENTION

It is amoung the objects of this invention to provide a new and useful closet shelf bracket pair which can be made from a single piece of sheet metal, requiring no assembly prior to installation.

A further object of the present invention is to provide a new and useful shelf bracket pair which can be fastened quickly and securely to any wood frame constructed closet. Testing on a protype shelf bracket pair indicates an installation time of approximately four minutes and each shelf bracket can carry a load in excess of seventy five pounds.

A further object of the present invention is to provide a new and useful shelf bracket pair that never requires any other hardware to be attached or fastened to the closet wall to support the shelf board. The shelf bracket pair contains all the necessary features to support and hold the shelf board and a load carrying member.

A further object of the present invention is to provide a new and useful shelf bracket pair that aligns the shelf bracket attachment hardware with an internal wall stud during installation thus assuring consistent strength and load carrying ability for each assembly.

In accordance with this invention, sheet metal is cut, pierced, and formed to make the closet shelf bracket pair and both brackets are identicle in features except they are a mirror image to one another thus forming a left and right hand pair. The main body of each bracket is flat with tabs bent perpendicular to the main body and toward the inside of the bracket. A bottom tab, formed horizontally at the lower rear of the bracket, with two vertical tabs spaced horizontally apart and located above said bottom tab, form a guide and support for the installation of a load bearing member. Two horizontal tabs in the top forward portion of the bracket and spaced vertically apart form a guide for the installation of a shelf board into the shelf bracket pair and provides support for the forward front ends of the shelf board after installation. The rear of the shelf board is supported by the top surface of the load bearing member. A tab formed horizontally at the upper rear portion of the bracket prevents the rear of the shelf board from rising vertically. Hardware mounting holes are located in the upper and lower rear of the shelf bracket and are so positioned so as not to interfer with the installation of the load bearing member or the shelf board and are also positioned to provide alignment of the shelf bracket mounting hardware with an internal wall stud.

The features and functions of the present invention will be better understood in view of the following descriptions taken in conjunction with the drawings herein.

DESCRIPTION OF THE PREFERRED EMBODIMENT

Figure 1:
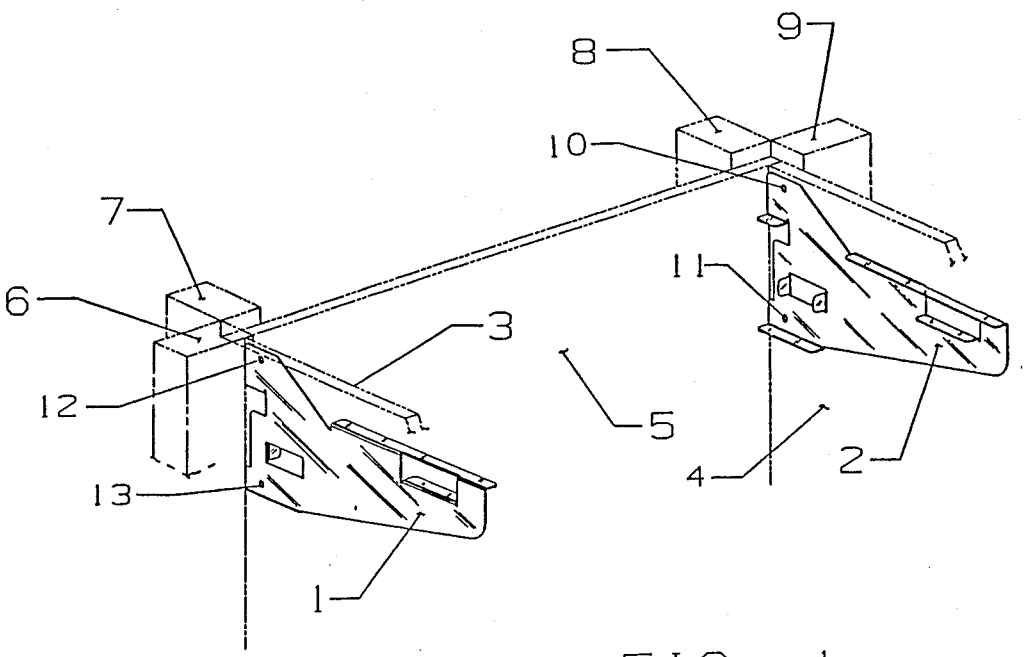
FIG. 1 is an isometric view of a shelf bracket pair, installed in a closet, awaiting installation of the load bearing member and the shelf board.

Refering to FIG. 1, there is shown a left hand closet shelf bracket, item 1, attached to the left side wall, item 3, of a closet by means of two screws, (item not shown), going thru mounting holes, items 12 and 13, thru the side wall, item 3, and secured into the internal wall stud, item 6. Also shown in FIG. 1 is a right hand closet shelf bracket, item 2, attached to the right side wall, item 4, by means of two screws, ( item not shown ), going thru mounting holes, items 10 and 11, thru the side wall, item 4, and secured into the internal wall stud, item 9.

The type of construction of this closet in FIG. 1 is of a standard wood frame nature with any type of finish wall, items 3,4, and 5, plaster, wall board, paneling, etc., over fir wall studs. The standard corner wall studding is shown, items 6 and 7 forming the left hand rear corner and items 8 and 9 forming the right hand rear corner.

Because the left and right hand shelf brackets, items 1 and 2, fully support the shelf board loading, it is by design that no additional hardware or bracing is required to attach to any finish wall, items 3,4, or 5, to provide shelf board support. It is to be noted that this concept as shown in FIG. 1 always provides rigid support members, studding, items 6 and 9, for securing the shelf brackets, items 1 and 2, to and never is the plaster, wall board, paneling, etc. of the finish walls, items 3,4, or 5, required to become load bearing elements. Also this concept provides for a very quick installation time of the shelf brackets, items 1 and 2, to the side walls, items 3 and 4, as only four number 12 sheet metal screws , ( item not shown ), are required. This is also a very strong assembly as just one number 12 sheet metal screw can withstand a shear load in excess of four hundred pounds.

Figure 2:
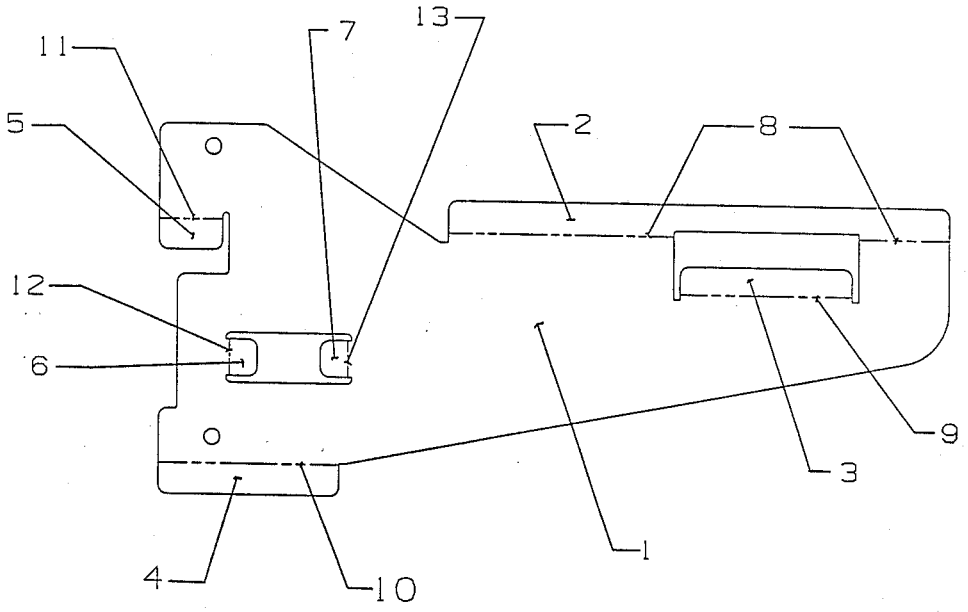
FIG. 2 is a plan view of a sheet metal blank from which the shelf bracket pair is formed.
Figure 3:
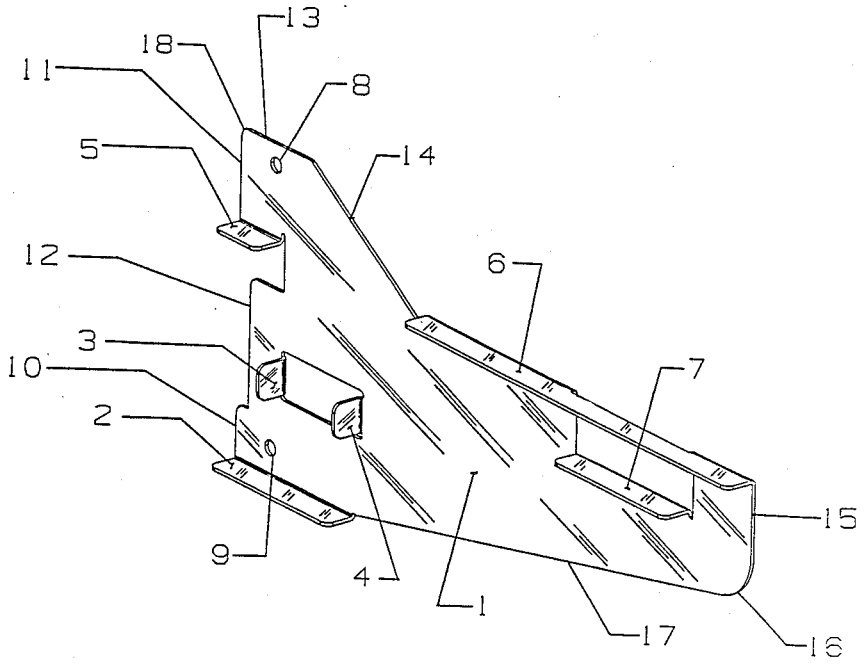
FIG. 3 is an isometric view of the right hand shelf bracket with all features being numbered.
Figure 4:
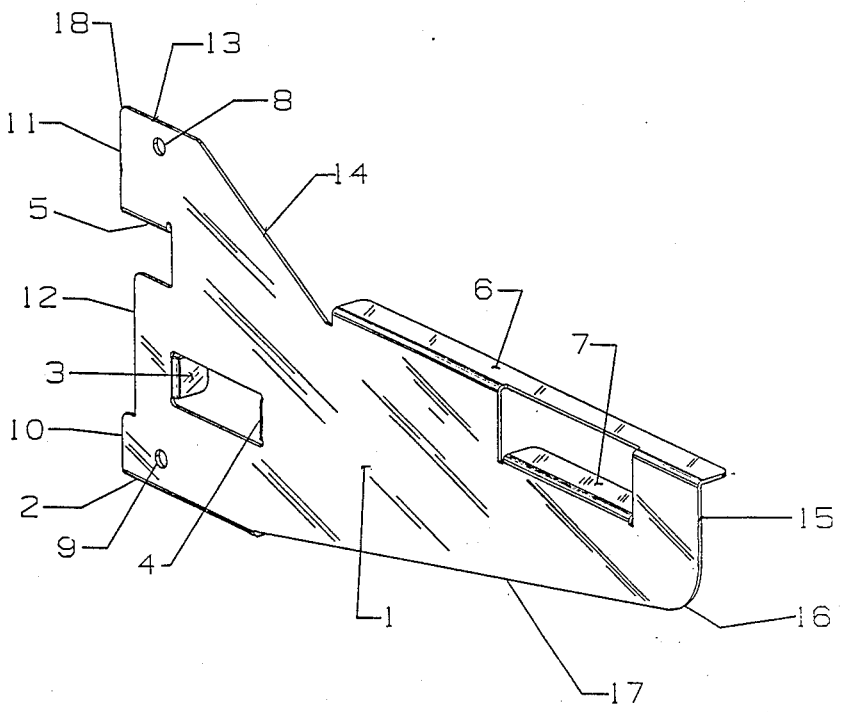
FIG. 4 is an isometric view of the left hand shelf bracket with all features being numbered.

Referring to FIG. 2, the blank, cut from a sheet of metal, is used to make the right and left hand shelf brackets, FIG. 3 and FIG. 4. To form the right hand shelf bracket, FIG. 3, the blank, FIG. 2, has tabs, items 2,3,4,5,6 and 7, bent forward, perpendicular to the main body, item 1, and along fold lines, items 8,9,10,11,12 and 13 respectively. To form the left hand shelf bracket, FIG. 4, the blank, FIG. 2, has tabs, items 2,3,4, 5,6 and 7, bent rearward, perpendicular to the main body, item 1, and along fold lines, items 8,9,10,11,12 and 13 respectively.

Figure 5:
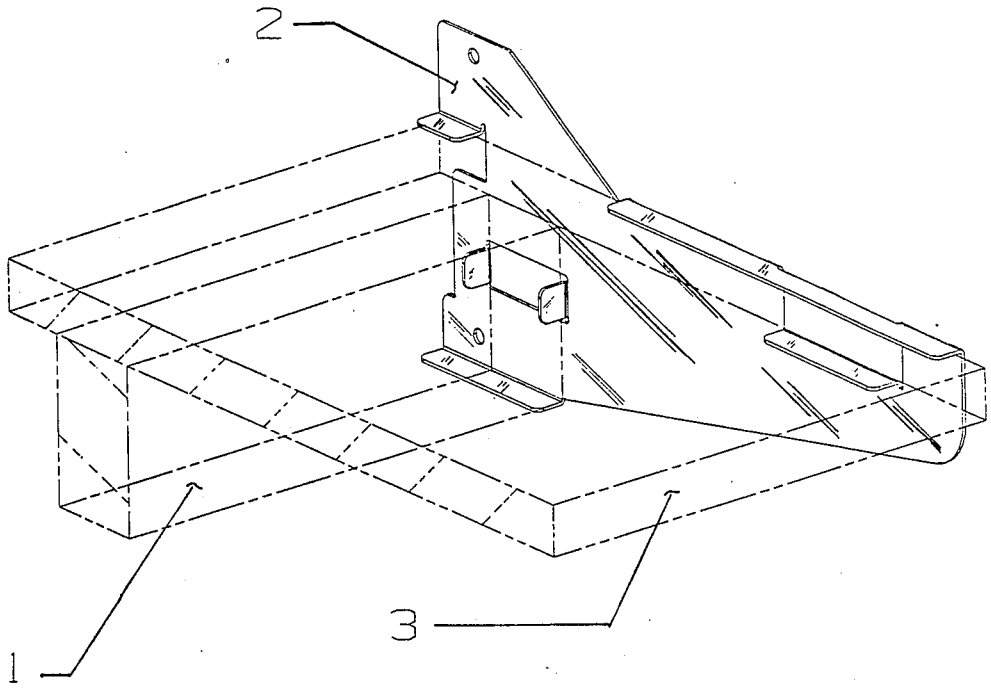
FIG. 5 is an isometric assembly drawing depicting a right hand shelf bracket with a shelf board and load bearing member section installed.

The left and right hand shelf brackets, FIG. 3 and FIG. 4, are identicle except for being a mirror image of one another. In order to simplify the description, the same reference numerals have been assigned to the identicle elements of FIG. 3 and FIG. 4. Thus referring to FIG. 3, the shelf bracket has a flat main body, item 1. In the top forward portion, a tab, item 6, is bent perpendicular to the main body, item 1, and lies in a horizontal plane. The right hand forward edge of tab, item 6, aligns with the forward vertical edge, item 15. The forward vertical edge, item 15, and tapered edge, item 17, transform together thru curved edge, item 16. Tapered edge, item 17, tapers down and to the left starting from curved edge, item 16, and ending at the right hand side of tab, item 2. Tab, item 2, is bent perpendicular to the main body, item 1, and lies in a horizontal plane. The left side of tab, item 2, aligns with the vertical lower rear edge, item 10 Rear vertical edge, item 12, is parallel to and recessed forward of lower rear vertical edge, item 10, and upper rear vertical edge, item 11. The recess of vertical edge, item 12, gives clearance from any protrusion from the rear closet wall, FIG. 1, item 5, thus assuring proper seating of the vertical rear edges, items 10 and 11, against the rear closet wall, FIG. 1, item 5. A tab, item 5, is formed in the upper rear portion of the main body, item 1, bent perpendicular to said main body and lies in a horizontal plane. The left hand edge of tab, item 5, is in vertical alignment with rear vertical edges, items 10 and 11. Upper rear vertical edge, item 11, transforms into upper horizontal edge, item 13, thru curved edge, item 18 Tapered edge, item 14, tapers down and forward starting from the forward end of horizontal edge, item 13, and ends at the left hand side of tab, item 6. In the lower rear portion of said main body, two tabs, items 3 and 4, are bent perpendicular to said main body in a vertical direction and spaced horizontally apart. Thus a channel exist between tabs, items 3 and 4, which functions as a guide for the insertion of a load bearing member, FIG. 5, item I, into the shelf bracket, FIG. 3. Said load bearing member comes to rest on and is supported by tab, item 2. Referring to FIG. 3. in the forward middle of the said main body, tab, item 7, is bent perpendicular to said main body and in a horizontal direction. Thus a channel exist between tabs, items 6 and 7, which function as a guide during the insertion of the shelf board, FIG. 5, item 3, into the shelf bracket, FIG. 3. After installation said shelf board is supported in the forward end by tab, item 7, and supported along the rear edge by the top surface of load bearing member, FIG. 5, item 1. Referring the FIG. 3, tab, item 5, prevents the rear of said shelf board from rising vertically. This can better be seen by looking at FIG. 5 also. Referring to FIG. 3, means of attaching the shelf bracket, FIG. 3, to the closet wall, FIG. 1, item 4, is provided by two thru holes, items 8 and 9, in the rear portion of the main body, item 1, for insertion of fasteners, number twelve sheet metal screws, (item not shown).

CONCLUSION

The invention in its preferred embodiment has been explained and illustrated but it is understood that the invention is limited only by the appended claims.

I claim:

1. A support apparatus for a generally flat elongated shelf comprising: (a) a first bracket, said first bracket comprising:

(1) a flat vertical rigid main body having a top edge, a bottom edge, a forward edge and a rearward edge, and a first horizontal tab which extends substantially horizontally from one side of said main body and which is substantially adjacent said rearward and bottom edges of said main body, and (3) a second tab which extend substantially horizontally from said one side of said main body and substantially adjacent to said top and forward edges of said main body, said second tab being located above and forward of said first tab, (b) a second bracket which is a mirror image of said first bracket so that the horizontal tabs of said first bracket face the tabs of said second bracket when the rearward edges of said first and second brackets are at the same vertical height, and (c) an elongated shelf support beam having a top surface and a bottom surface which rests on the first horizontal tabs of said first and second brackets, the vertical thickness of said support beam being such that said top surface is at the same vertical height as the top of said second horizontal tabs, whereby when a flat elongated shelf is supported by said first and second brackets, said shelf rests on said support beam and the second tabs of said first and second brackets wherein each of said brackets has restraining means for preventing a support beam which is placed on said first horizontal tab from moving forwardly and rearwardly, said restraining means comprising a first vertical tab which is fixed to said one side of the bracket and which extends toward the other bracket in front of said support beam, and a second vertical tab which is fixed to said one side of the bracket which extends toward the other bracket in back of said support beam.

2. A support apparatus as recited in claim 1, wherein each of said brackets has restraining means for preventing a shelf of a predetermined thickness from being moved upwardly when said shelf rests on said second tab and said support beam., 3. A support apparatus as recited in claim 2, wherein said restraining means comprises a third horizontal tab which extends horizontally from said one side of the main body.

4. A shelf assembly for a closet comprising:

(a) a first bracket, said first bracket comprising:

(1) a flat vertical rigid main body having a top edge, a bottom edge, a forward edge and rearward edge, and (2) a first horizontal tab which extend substantially horizontally from one side of said main body and which is substantially adjacent said rearward and bottom edges of said main body, and (3) a second horizontal tab which extends substantially horizontally from said one side of said main body and which is substantially adjacent said top and forward edges of said main body, said second tab being located above and forward of said first tab, (b) a second bracket which is a mirror image of said first bracket so that the horizontal tabs of said first bracket face the horizontal tabs of said second bracket when the rearward edges of said first and second brackets are positioned against a wall, and said first and second brackets are at the same vertical height, and (c) an elongated shelf support beam having a top surface and a bottom surface which rests on the first tabs of said first and second brackets, the vertical thickness of said support beam being such that said top surface is at the same vertical height as the top of said second tabs, whereby when a flat elongated shelf is supported by said first and second brackets, said shelf rests on said support beam and the second tabs of said first and second brackets, and (d) a shelf having a predetermined vertical thickness which is supported on said support beam and the second tabs of said first and second brackets.

5. A shelf assembly as recited in claim 4, wherein each of said brackets has restraining means for preventing a support beam which is placed on said first tab from moving forwardly and rearwardly.

6. A shelf assembly as recited in claim 5, wherein the restraining means for each of said brackets comprises:

(a) a first vertical tab which is fixed to said one side of the bracket and which extends toward the other bracket in front of said support beam, and (b) a second vertical tab which is fixed to said one side of the bracket and which extends toward the other bracket in back of said support beam.

7. Shelving apparatus as recited in claim 4, wherein each of said brackets has restraining means for preventing a shelf of a predetermined thickness from being moved upwardly when said shelf rests on said second tab and said support beam.

8. Shelving apparatus as recited in claim 7, wherein said restraining means comprises a third horizontal tab which extends horizontally from said one side of the main body.

* * * * *